US005134922A

United States Patent [19]

Menges et al.

[11] Patent Number: 5,134,922

[45] Date of Patent: Aug. 4, 1992

[54] RIGIDLY LOCKABLE STRAIGHT-ACTION BREECH BLOCK FOR AN EXTERNALLY DRIVEN AUTOMATIC WEAPON

[75] Inventors: Horst Menges, Ratingen; Lothar Post, Düsseldorf; Bernhard Schneider, Niederkrüchten, all of Fed. Rep. of Germany

[73] Assignee: Rheinmetall GmbH, Düsseldorf, Fed. Rep. of Germany

[21] Appl. No.: 92,733

[22] Filed: Aug. 17, 1987

[30] Foreign Application Priority Data

Aug. 16, 1986 [DE] Fed. Rep. of Germany ..... 3627361

[51] Int. Cl.[5] ..... F41A 3/00; F41A 7/00

[52] U.S. Cl. ..... 89/11

[58] Field of Search ..... 89/11, 9, 187.01

[56] References Cited

U.S. PATENT DOCUMENTS

| | | | |
|---|---|---|---|
| 3,648,561 | 3/1972 | Stoner | 89/11 |
| 4,167,888 | 9/1979 | Pechamat et al. | 89/11 |
| 4,172,410 | 10/1979 | Reynolds et al. | 89/11 |
| 4,708,049 | 11/1987 | Durant | 89/11 |

FOREIGN PATENT DOCUMENTS

| | | | |
|---|---|---|---|
| 491839 | 6/1919 | France | 89/9 |

*Primary Examiner*—David H. Brown

*Attorney, Agent, or Firm*—Spencer, Frank & Schneider

[57] ABSTRACT

For a space saving and shock free breech block for an externally driven automatic weapon, a control roller 10 includes two camming discs which offset by 180° with respect to one another in a symmetrical manner and arranged one behind the other, so as to continuously rotate in the same direction as the control roller. For the displacement of two locking bars disposed on opposite sides of the breech block 9 in a direction transverse to the direction of movement of the breech block, respective slide members are arranged between the breech block guide path axis and the control roller 10. Each slide member grips around one of the camming discs by meane of a U-shaped pocket and transfers the transverse movement of the associated camming disc to an associated one of the locking bars for locking and unlocking breech block 9 in a form locking manner.

5 Claims, 3 Drawing Sheets

RIGIDLY LOCKABLE STRAIGHT-ACTION BREECH BLOCK FOR AN EXTERNALLY DRIVEN AUTOMATIC WEAPON

CROSS REFERENCE TO RELATED APPLICATIONS

The present application is related to applicants' following concurrently filed United States Patent Applications, the subject matter of which are incorporated herein by reference:

(1) U.S. patent application Ser. No. 07/092,734, entitled RAPID STOP DEVICE FOR AN EXTERNALLY DRIVEN AUTOMATIC WEAPON;

(2) U.S. patent application Ser. No. 07/094,261, entitled ALTERNATABLE DUAL CARTRIDGE SUPPLY SYSTEM FOR AN EXTERNALLY DRIVEN AUTOMATIC WEAPON and (3) U.S. patent application Ser. No. 07/094,260, titled RAPID STOP DEVICE FOR AN EXTERNALLY DRIVEN AUTOMATIC WEAPON.

BACKGROUND OF THE INVENTION

The present invention relates to a rigidly lockable straight-action breech block for an externally driven automatic weapon of the type including a control roller having control grooves which are engaged in a form locking manner, by means for transporting the straight action breech block, in which a firing pin is displaceably mounted, so as to move the firing pin into its firing position, and locking device for the breech block which includes two camming elements which are arranged to move two locking bars, which are located on opposite sides of the straight-action breech block and linearly displaceable transversely to the path of movement of the breech block, in opposite directions.

A rigidly lockable straight-action breech block has already been described in Federal Republic of Germany Patent Application Serial Number P 32 04 722, corresponding to allowed U.S. patent application Ser. No. 06/468,169, now U.S. Pat. No. 4,807,513. However, this previously described arrangement requires two oppositely rotating control rollers to control and lock the straight-action breech block. To lock the breech block, a camming disc disposed on each control roller displaces two locking bars moving in opposite directions either toward one another into the locking position or away from one another for unlocking. This arrangement and mode of operation ensures a reliable lock but it can be used only for use with two control rollers. During the return movement of the firing pin, which is displaceably disposed in the breech block, from a firing position into a rest position, it is further considered to be a drawback that, in the rest position, the firing pin is held by a spring which is subject to wear so that, under certain circumstances the safety of the weapon may be adversely affected.

SUMMARY OF THE INVENTION

In contrast to the above described arrangement, it is an object of the present invention to provide an arrangement for locking a rigidly lockable straight-action breech block which includes control or camming discs driven by a single control roller to lock the breech, and to provide for locking of the firing pin in the rest position in a form locking manner in dependence on the movement of the breech block.

The above object is achieved according to the present invention in that in an externally driven automatic weapon comprising a housing, a rigidly lockable straight action breech block mounted with the housing for movement along a linear breech block guide path, a firing pin mounted in the breech block for axial movement between a rest position and a fired position, a control roller, having control grooves on its outer surface, mounted within the housing for rotation about an axis parallel to the guide path, means engaged in the control grooves in a form locking manner for moving the breech block along the guide path upon rotation of the control roller to bring the firing pin into a firing position, and locking means for rigidly locking the breech block against axial movement when the firing pin has been moved to the firing position, with the locking means including first and second locking bars mounted within the housing on opposite sides of the breech block guide path and linearly displaceable in a direction transverse to the breech block guide path in opposite directions so as to lock the breech block when moved toward each other and release the breech block when moved apart, and first and second camming discs for controlling the movement of the first and second locking bars, respectively; the control roller is symmetrically disposed relative to the locking bars; the first and second camming discs are fixedly mounted one behind the other on the control roller for rotation with the control roller; the locking means further includes means for transferring the transverse movement of each camming disc parallel to the direction of displacement of the locking bars to a respective locking bar, with this means for transferring comprising first and second slide members mounted in the housing between the guide path and the control roller for displacement in a direction parallel to the direction of displacement of the locking bars and with the first and second slide members being connected in a form locking manner with the first and second camming discs, respectively; and means, including an arresting pin mounted in the breech block and engageable with the firing pin and the guide path are provided for securing the firing pin in its rest position when the firing pin is not in the firing position.

The invention makes it possible, in an advantageous manner, to securely lock the breech block without shock in a space saving manner. These advantages become possible, in particular, in that each locking bar is moved by one of two slides disposed between the axis of the breech block guide path and the sole control roller disposed transversely and symmetrically to the locking bars, with the slides being displaceable by two camming discs which rotate in the same direction as the control roller. Due to the fact that the camming discs are disposed on the control roller with an offset of 180°, and each locking slide transfers the transverse movement of only one camming disc to one locking bar, the locking bars can be moved toward one another in a particularly advantageous and form locking manner by only one control roller to lock the breech and away from one another to unlock it.

Furthermore, the safety of firing pin operation is increased in that the firing pin, outside of its firing position, is secured in a form locking manner by an arresting bolt which engages the path guide of the breech block.

The invention will be described below in greater detail with reference to an embodiment that is illustrated in the drawing figures.

DETAILED DESCRIPTION OF THE PREFERRED EMBODIMENT

Figure 1:
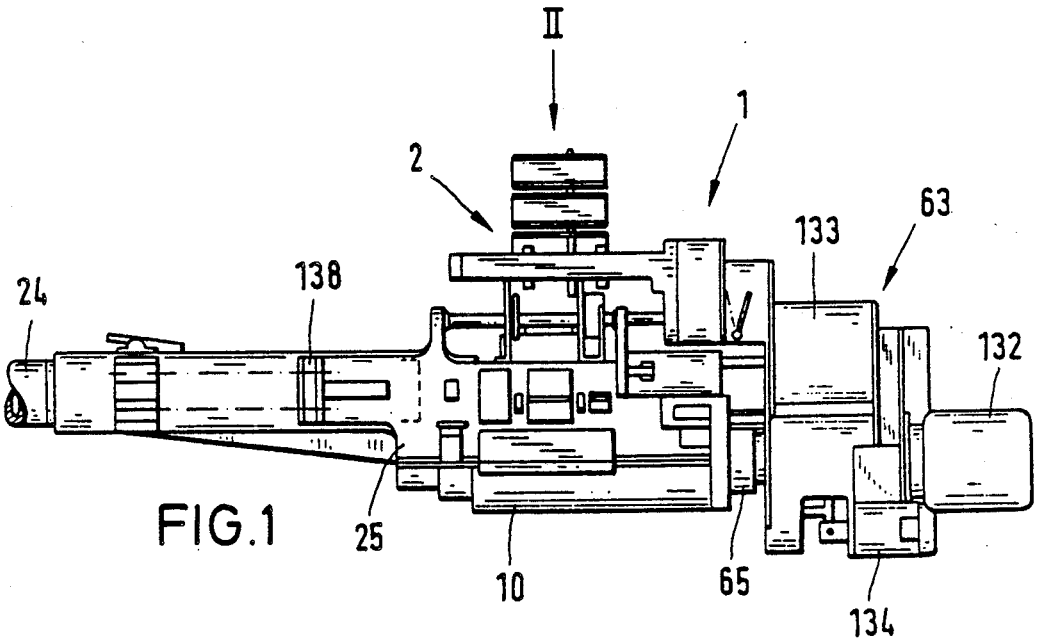
FIG. 1 is a side view of an externally driven automatic cannon including the present invention.
Figure 2:
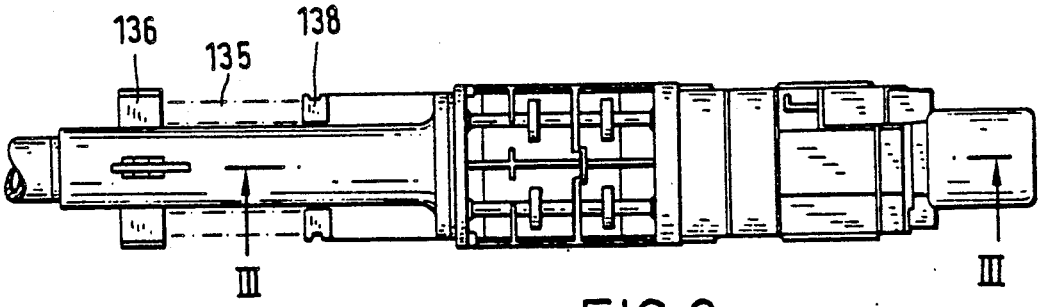
FIG. 2 is a top view in the direction marked II in FIG. 1.

FIGS. 1 and 2 show the overall structure of an externally driven automatic weapon 1 in which the drive 132 for the weapon, an associated gear assembly 133, a trigger mechanism 134, a brake unit 65 for the control drum 10 and a partial region of an alternatable dual cartridge supply system 2 are disposed in a housing 63 which is fixed to the cradle or the gun mount. In a housing 25 which is connected with the gun barrel 24 and recoils together therewith when a shot is fired, there are disposed the control roller 10 for the breech drive and a breech block, a recoil braking and counter-recoil device 135 as well as a further partial region of the alternatable dual cartridge supply system 2.

Housing 25, which is fixed to the weapon, is provided on its exterior with slide guides 136 for fastening it within a weapon carrier which may be articulated in the form of a gun mount (not shown) or a cradle in the turret system (likewise not shown) of a tank. The weapon housing is equipped with two fast action locks, one lock 138 connecting weapon housing 25 with the weapon carrier, while the other lock (not shown) is disposed at the point of intersection between the ammunition guide and weapon housing 25.

Figure 3:
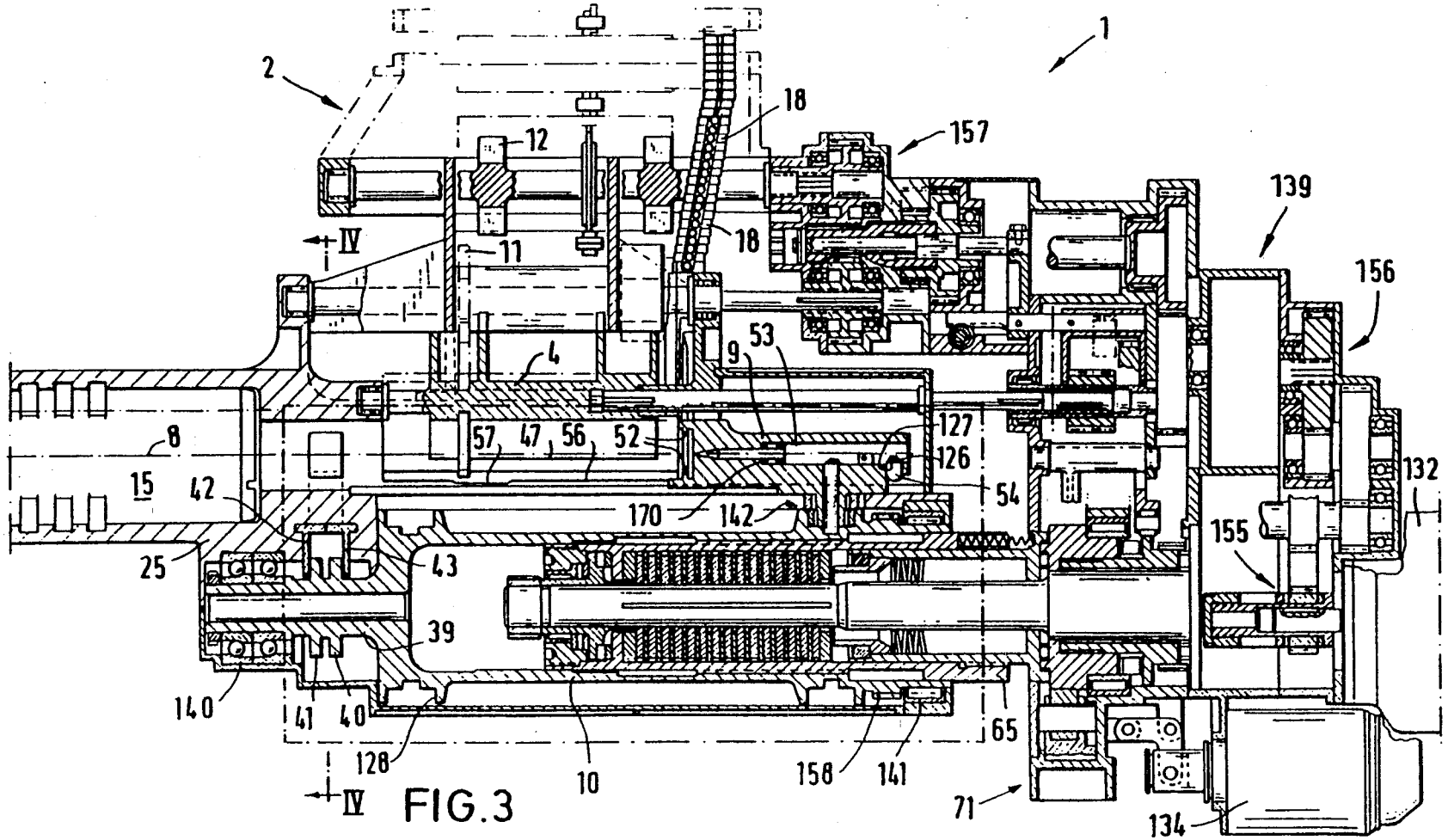
FIG. 3 is a longitudinal sectional view of the automatic weapon according to the invention along line III—III of FIG. 2.

FIG. 3 shows in detail the structure of automatic weapon 1, with the part of the breech control and breech block significant for the invention being surrounded by a dot-dash line.

The region of the cartridge intake within the alternatable dual cartridge supply system 2, which is essentially composed of star wheels 11, 12, a rotor 4, cartridge guide means 18 and gears 157 (change gear), 139 (stepping gear), 156 (distribution gear) and, 155 (intermediate gear), with all gears being interconnected in a form locking manner, is the subject of the above identified concurrently filed U.S. patent application Ser. No. 07/094,261 so that a more detailed description thereof need not be given here. Moreover, the illustrated rapid-stop device 71 for the control roller 10 is the subject of still another of the above identified concurrently filed U.S. patent applications, and in particular U.S. application Ser. No. 07/092,734 so that in this connection as well, a more precise description need not be given here. The stop device 71, which becomes active as a function of the gas pressure upon a detonator malfunction or is activated by the trigger mechanism 134 of the weapon, interrupts the weapon drive by means of a brake unit 65 disposed within the control roller 10.

Control roller 10 is provided with a gear 158 which, during firing, is continuously driven by distribution gears 156 by means of a gear assembly (not shown). Control roller 10 is mounted in weapon housing 25 by means of a forward bearing 140 and a rear bearing 141 so that the control roller 10 is parallel to the extended bore axis 8 of the gun barrel. Moreover, the control roller 10 is provided, on its exterior surface, with control grooves 128 for controlling the longitudinal movement of a straight-action breech block 9 which moves a cartridge (not shown) into the chamber 15. Breech block 9 performs this longitudinal movement in a known manner by means of control means 142 which engage in control grooves 128 as disclosed for example essentially in the above identified prior filed German and corresponding United States Patent Applications.

The front end of the breech block 9 is provided with rigid extraction claws 52 which are used by the breech block 9 to move a cartridge along the axis 47 of the breech block path guide 56, which axis 47 changes to, i.e., is coaxial with the bore axis 8 of the gun barrel, into chamber 15 without shock and, after firing, to extract the cartridge casing from the chamber 15. Within breech block 9, a firing pin 53 is disposed for axial displacement in a known manner in a direction toward the chamber 15. When the breech block 9 and hence the firing pin 53 is in the outside or not in the firing position, the firing pin 53 is secured in its rest position in a form locking manner by means of an arresting bolt 54 which extends into a recess formed in the breech block 9 in a direction transverse to the axis 47 and which rests on or engages the breech block path 56. In order to secure firing pin 53 in the rest position, arresting bolt 54 has a sloped end surface 126 which rests in a corresponding depression 127 provided in firing pin 53 disposed transversely to the axis 47, and has a length such that its end opposite sloped surface 126 simultaneously rests against the breech block path guide 56. To permit arresting bolt 54 to move out of engagement with the firing pin 53 when the breech block 9 is in the locked or firing position, a recess or depression 57 is provided in the frontal region of breech block path guide 56. After the firing pin 53 has struck a cartridge, a spring 170 disposed in the breech block 9 causes the firing pin 53 to move back into the position in which it is to be arrested by the arresting bolt 54.

Between forward bearing 140 and the region roller 10 containing the control track 128, two camming discs 40, 41 for controlling two slide members 42, 43 are disposed one behind the other on a projection or shaft portion 39 of control roller 10 for rotation with same. These slide members 42, 43 move locking bars 37, 38 (FIG. 4) into and out of the locked position for the breech block 9. The configuration of these locking slide member 42, 43 and the entire locking arrangement will be described in greater detail with reference to FIG. 4.

Figure 4:
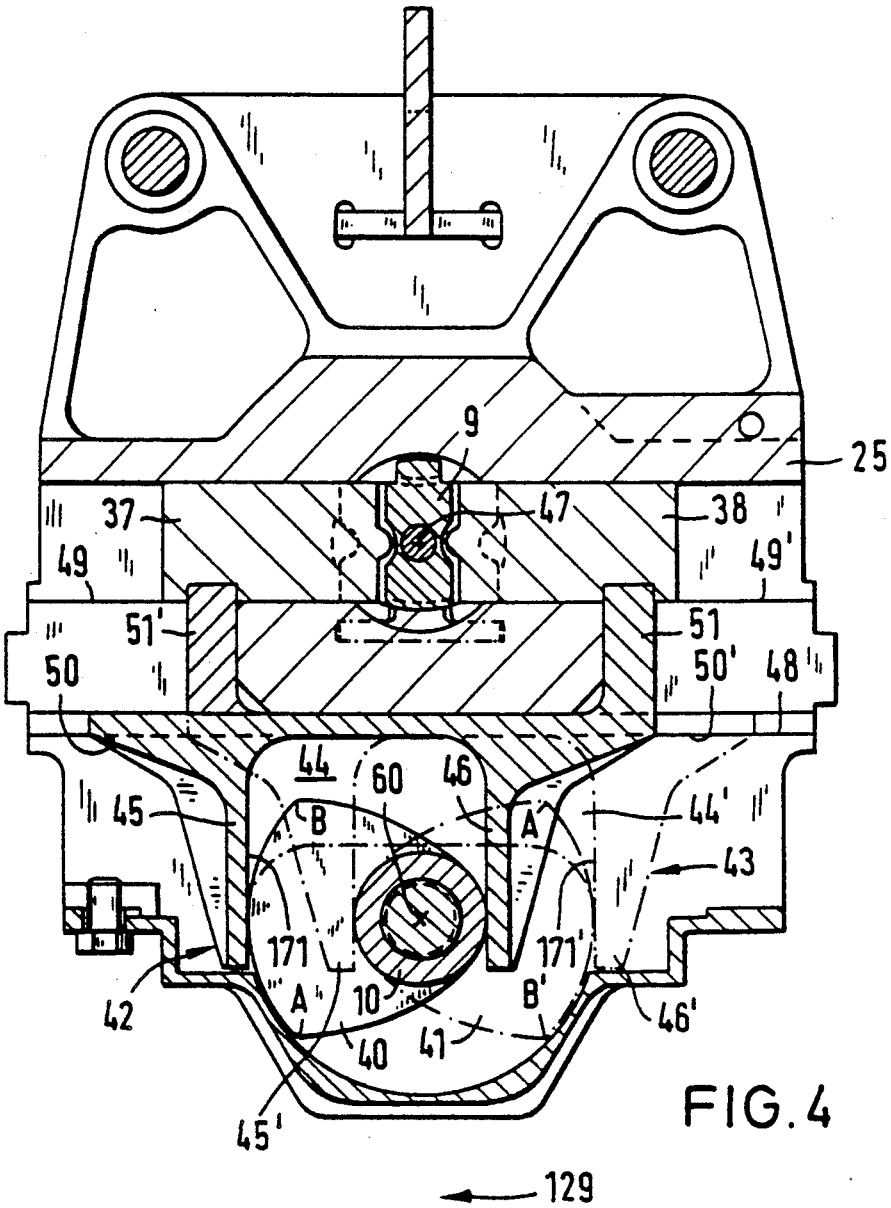
FIG. 4 is a cross-sectional view seen along line IV—IV of FIG. 3 but showing the breech block in the locked position.

In FIG. 4, breech block 9 is in a locked position. Locking bars 37, 38, which serve to block the breech are disposed on opposite sides and transversely to the breech path guide axis 47, in respective guides 49, 49' of weapon housing 25 so as to be moveable in the transverse direction. Both 40, 41, of the camming discs, which are shown have essentially the shape of a circular segment, with curved radii, are offset by 180° and are arranged symmetrically on the sole control roller 10. Control roller 10, in turn, is arranged transversely and symmetrically to both locking bars 37, 38. Slide member 42, 43, are disposed between the breech block path guide axis 47 and control roller 10 so as to be displaceable in a direction parallel to the locking movement, and are provided to transfer the transverse movement parallel to the movement of the locking bars 37, 38 of the camming discs 40, 41, which rotate in the same direction as control roller 10 to the locking bars.

Each slide member 42, 43 includes a plate member provided with a slide surface 50, 50', respectively which is in sliding engagement with a guide 48 disposed in the housing between the control roller 10 and path axis 47 and extends parallel to the direction of movement of the locking bars 37, 38. At their respectively opposite ends, each plate member of the slide members 42, 43 is provided with a projection 51, 51', respectively which extends toward and forms a form locking connection with the associated one of the locking bars 37, 38. Each slide 42, 43 additionally includes a pair of arms 45, 46 and 45', 46' respectively, which extend from the surface of the plate member containing the slide surfaces 50, 50' respectively to form a respective U-Shaped pocket 44 or 44'. Each pair of arms 45, 46 and 45' and 46' surrounds a respective one of the camming discs 40, 41 and slidingly contacts the peripheral edge or camming surface of same. In the illustrated locking position of the camming discs 40, 41, the interim surface of both arms of each pair is in contact with the associated camming disc.

Pockets 44 and 44' and projections 51 and 51' are arranged on the respective slide member 42 and 43 in such a manner that, in the illustrated locked position of the breech block 9, pocket 44 of the slide member 42 actuating the right hand locking bar 38 is disposed at the left stroke end of camming disc 40 which has been moved to the left in rotation direction 129, and pocket 44' of slide member 43 which actuates the left hand locking bar 37 is disposed at the right stroke end of the camming disc 41 which has been moved to the right in the rotation direction 129.

The symmetrical arrangement of both camming discs 40, 41 keeps the locking bars 37, 38 in the locked position until camming discs 40, 41, which continue to rotate around axis 60 of control shaft 10 in the same direction, relinquish their contact with the interior 171 of arm 45 or with the interior 171' of arm 46 within an arcuate region A-B that is radially equidistant from axis 60. After misfire, the points marked A and A', respectively, of both camming discs 40, 41 leave arms 45, 46', so that slides 42, 43 and thus locking bars 37, 38 are moved outwardly in opposite directions to unlock breech block 9.

It will be understood that the above description of the present invention is susceptible to various modifications, changes and adaptations, and the same are intended to be comprehended within the meaning and range of equivalents of the appended claims.

What is claimed is:

1. In an externally driven automatic weapon comprising a housing, a rigidly lockable straight-action breech block mounted with said housing for movement along a linear breech block grid path, a firing pin mounted in said breech block for axial movement between a rest position and a fired position, a control roller, having control grooves on its outer surface, mounted within said housing for rotation about an axis parallel to said guide path, means engaged in said control grooves in a form locking manner for moving said breech block along said guide path upon rotation of said control roller to bring said firing pin into a firing position, and locking means for rigidly locking said breech block against axial movement when said firing pin has been moved to said firing position, said locking means including first and second locking bars mounted within said housing on opposite sides of said breech block and linearly displaceable in a direction transverse to said path of said breech block in opposite directions so as to lock said breech block when moved toward each other and release said breech block when moved apart, and first and second camming discs for controlling the movement of said first and second locking bars, respectively; the improvement wherein: said control roller is symmetrically disposed relative to said locking bars; said first and second camming discs are fixedly mounted one behind the other on said control roller for rotation with said control roller; said locking means further includes means for transferring the transverse movement of each said camming discs parallel to said direction of displacement of said locking bars to a respective said locking bar, with said means for transferring comprising first and second slide members mounted in said housing between said guide path and said control roller for displacement in a direction parallel to said direction of displacement of said locking bars and with said first and second slide members be connected in a form locking manner with said first and second camming discs, respectively; and means, including an arresting pin mounted in said breech block and in engagement with said firing pin and said guide path for securing said firing pin in its rest position when said firing pin is not in the firing position.

2. An externally driven automatic weapon as defined in claim 1, wherein said camming discs are symmetrically arranged on said control roller so as to be offset with respect to one another by 180°.

3. An externally driven automatic weapon as defined in claim 2, wherein each said slide member includes:

a plate with a slide surface which is in sliding engagement with a guide disposed on said weapon housing between said roller and said guide path and extending parallel to the direction of movement of said locking bars;

a pair of arms which form a U-shaped pocket and extend from the surface of said plate containing said slide surface and surround a respective one of said camming discs and contact same in a sliding manner; and a projection disposed at one end of said plate and extending toward and being fixedly connected with the associated one and said locking bars; and wherein said pair of arms of each said slide member are arranged in such a manner with respect to the associated said locking bar that, with said breech block in a locked position and when viewing said breech block in an axial direction, the associated said pocket of said slide member actuating the one of said locking bars on the right of said breech block is disposed at the left stroke end of the one of said camming discs which has been rotated to the left in the direction of rotation, and said pocket of said slide member actuating the other of said locking bars is disposed at the right stroke end of the other of said camming discs which has been rotated to the right in the same direction of rotation.

4. An externally driven automatic weapon as defined in claim 1, wherein said means for securing said firing pin includes a recess provided in said breech block guide path for permitting said arresting bolt to move out of engagement with said firing pin when said breech block is in said firing position.

5. An externally driven automatic weapon as defined in claim 4, wherein: said arresting bolt is mounted in a bore in said breech block extending transverse to the longitudinal axis of said firing pin and is provided with a sloped on its end facing said firing pin; said firing pin is provided with a corresponding shaped depression disposed opposite said bore; and said arresting pin has a length such that when its said one end is resting in said recess of said firing pin, its end opposite said sloped surface is in engagement with said block guide path whereby said firing pin is secured in said rest position.

* * * * *